United States Patent [19]

Hunt et al.

[11] 4,305,612

[45] Dec. 15, 1981

[54] APPARATUS FOR OPERATING A DOOR LATCHING AND UNLATCHING DEVICE

[75] Inventors: Larry R. Hunt; John R. Foster, both of Indianapolis, Ind.

[73] Assignee: Von Duprin, Inc., Indianapolis, Ind.

[21] Appl. No.: 927,100

[22] Filed: Jul. 24, 1978

[51] Int. Cl.[3] ..... E05C 13/00

[52] U.S. Cl. ..... 292/336.3

[58] Field of Search ..... 292/98, 124, 165, 197, 292/224, 336.3, 169

[56] References Cited

U.S. PATENT DOCUMENTS

| | | | |
|---|---|---|---|
| 333,656 | 1/1886 | Mix et al. | 292/224 |
| 1,489,965 | 4/1924 | Prentice | 292/197 X |
| 4,108,482 | 8/1978 | Dietrich et al. | 292/165 |

FOREIGN PATENT DOCUMENTS

| | | | |
|---|---|---|---|
| 113525 | 7/1941 | Australia | 292/165 |
| 3902 | of 1912 | United Kingdom | 292/165 |
| 534396 | 3/1941 | United Kingdom | 292/165 |
| 1114028 | 5/1968 | United Kingdom | 292/165 |

*Primary Examiner*—Richard E. Moore

*Attorney, Agent, or Firm*—Bernard J. Murphy; David W. Tibbott

[57] ABSTRACT

An apparatus for operating a door-latching and -unlatching device includes a thumbturn, a barrel cam, a shaft for coupling the thumbturn to the barrel cam to cause rotation of the barrel cam in response to movement of the thumbturn, a follower for the barrel cam and apparatus attaching the follower to the latch bolt to cause the latch bolt to move in response to actuation of the barrel cam. The illustrative barrel cam includes two generally diametrically opposed cam lobes such that rotation of the thumbturn either clockwise or counterclockwise retracts the latch bolt. The follower includes a bar which lies against the cam surface of the barrel cam, and the latch bolt moving apparatus includes an actuator arm which is pivotally mounted adjacent one of its ends, the follower pin being mounted intermediate the actuator arm ends, the follower pin being supported adjacent the barrel cam, and the actuator arm further including a roller retractor actuator adjacent its other end.

4 Claims, 7 Drawing Figures

APPARATUS FOR OPERATING A DOOR LATCHING AND UNLATCHING DEVICE

This invention relates to apparatus for operating a latching and unlatching device for doors and the like.

It is an object of the present invention to provide a simplified apparatus for operating a door-latching and -unlatching device.

According to the invention, an apparatus for operating a door-latching and -unlatching device includes a member for actuating a latch bolt, a barrel cam, means for coupling the actuating member to the barrel cam to cause rotation of the barrel cam in response to movement of the actuating member, a follower for the barrel cam and means coupling the follower to the latch bolt to cause the latch bolt to move in response to movement of the barrel cam.

In an illustrative embodiment, the barrel cam includes two generally diametrically opposed cam lobes such that rotation of the actuating member either clockwise or counterclockwise retracts the latch bolt. The follower includes an actuator pin which lies against the surface of the barrel cam, and the means coupling the follower to the latch bolt includes an actuator arm having two ends. The actuator arm is pivotally mounted adjacent one of its ends, the actuator pin being mounted intermediate the actuator arm ends, the actuator pin being supported adjacent the barrel cam, and the actuator arm further including a roller retractor actuator adjacent its other end.

Further according to the illustrative embodiment, the actuator arm is generally U-shaped in cross section, having a pair of lateral stiffening and support arms between which the actuator pin extends and is supported, and between which the roller retractor actuator is rotatably supported.

The invention may best be understood by referring to the following description and accompanying drawings which illustrate the invention. In the drawings.

Figure 1:
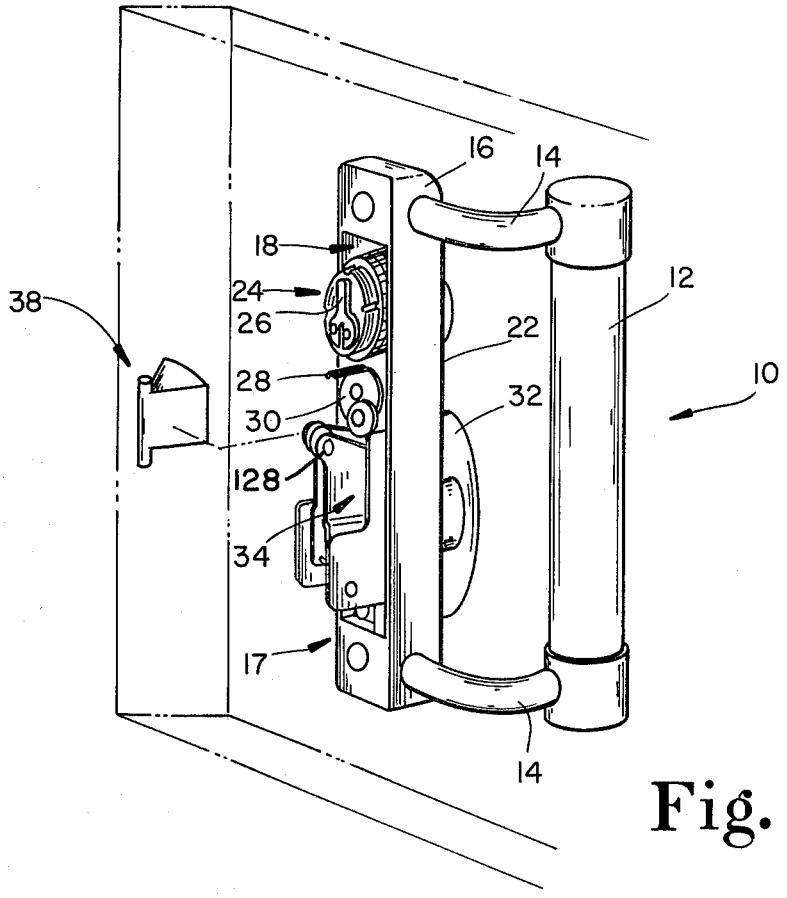
FIG. 1 is an isometric view of a device constructed according to the present invention mounted on a door, the door being illustrated in broken lines, and the interconnection of the apparatus of the instant invention with a pivotally mounted latch bolt also being illustrated in broken lines.
Figure 2:
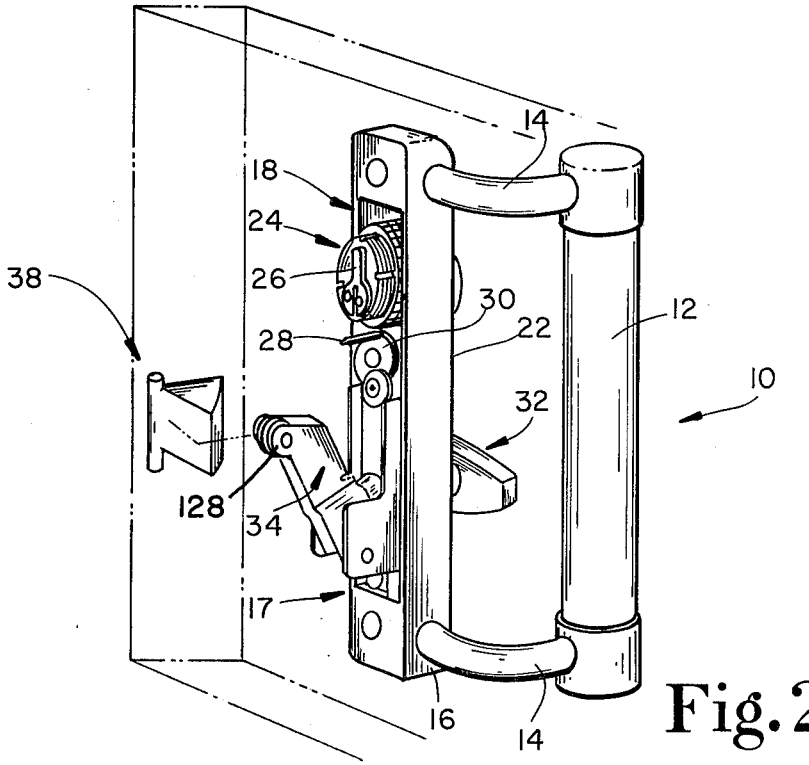
FIG. 2 is an isometric view of the apparatus of FIG. 1, with elements of the inventive apparatus and the latch bolt mechanism being illustrated in the door-opening position.

Referring now to FIGS. 1-2, the control assembly 10 of the instant invention includes a door handle 12 attached by brackets 14 at both ends thereof to a housing 16. The rearward (door) side 17 of housing 16 provides a recess 18 for retaining various components of the control assembly 10. The housing 16 defines an opening 20 (FIGS. 3-6) which extends therethrough from the front side 22 to the rearward side 18 thereof and supports a key actuated cylinder 24 (FIGS. 1-2). Cylinder 24 includes an actuator 26 which, when a key is inserted into the cylinder 24 and turned, engages a pin 28 which projects rearwardly from a pivotally mounted lock plate 30. When pin 28 is moved by actuator 26 to a first position, illustrated in FIG. 1, lock plate 30 prevents movement of a thumbturn assembly 32. When actuator 26 moves pin 28 to an unlocking position, illustrated in FIG. 2, lock plate 30 allows thumbturn assembly 32 to be turned, pivoting an actuator arm 34 rearwardly upon a rivet 96 and withdrawing a door latching device, illustratively a pivotally mounted latch bolt 38, to allow the door upon which control assembly 10 is mounted to be opened.

Turning now to FIGS. 3-6, the structure of control assembly 10 will be explained in greater detail. Housing 16 includes a post 40 upon which cylinder lock 42 of the instant apparatus is pivotally mounted. Cylinder lock 42 includes the previously mentioned lock plate 30, with pin 28 extending rearwardly therefrom, and an operating pin 44, which extends forwardly therefrom through mating apertures 46 in a pair of cylinder lock plates 48. It should be understood that two such plates 48 are provided in the instant arrangement for purposes of strength and that where such strength is not necessary, a single cylinder lock plate 48 can be used.

Housing 16 further includes a generally cylindrical bore 50 in the lower central portion thereof which extends from the front side 22 of the housing into the recessed rearward side 18. A turn lever bushing 52 is located in bore 50 against a flange 54 in the bore. Turn lever bushing 52 is secured in bore 50 by one or more screws 56 which extend through countersunk bores 58 in a lever back plate assembly 60 and mating threaded bores 62 in turn lever bushing 52. A central circular aperture 64 in lever back plate 60 receives a lever shaft bushing 66.

Thumbturn assembly 32 includes the conventional thumbturn 68 mounted on a cylindrical shaft 70 by a locking pin 72. Shaft 70 receives a lever return spring 74, one end of which is secured in a pocket 76 on the rearward side of thumbturn 68, and the other end of which is secured, after preloading the spring 74 by rotating the other end 90°, in a pocket (not shown) in turn lever bushing 52. Shaft 70 is then inserted into lever shaft bushing 66.

Figure 7:
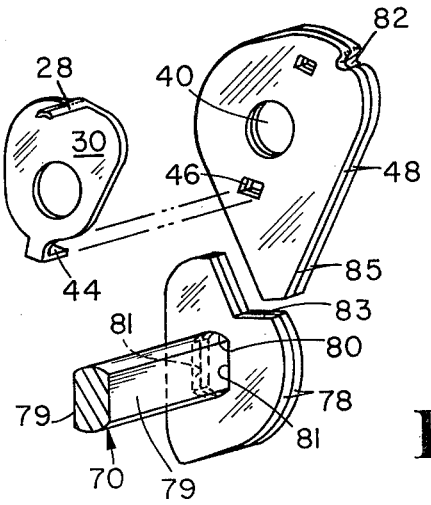

A pair of lever shaft lock plates 78 are placed over shaft 70. As best illustrated in FIG. 7, shaft 70 and the bores 80 of lock plates 78, through which shaft 70 is received, both contain two diametrically opposed flats 79, 81, respectively, to prevent rotation of lock plates 78 on shaft 70. Lock plates 78 include notches 83 into which protrusions 85 on cylinder lock plates 48 are moved when cylinder lock plates 48 are rotated into locking position by the engagement of actuator 26 with pin 28 of lock plate 30 and the engagement of operating pin 44 in the apertures 46 of cylinder lock plates 48. Again, it must be noted that two lever shaft lock plates 78 are provided for strength. A single such plate 78 can be used where the additional strength of the second plate is not necessary.

Figure 3:
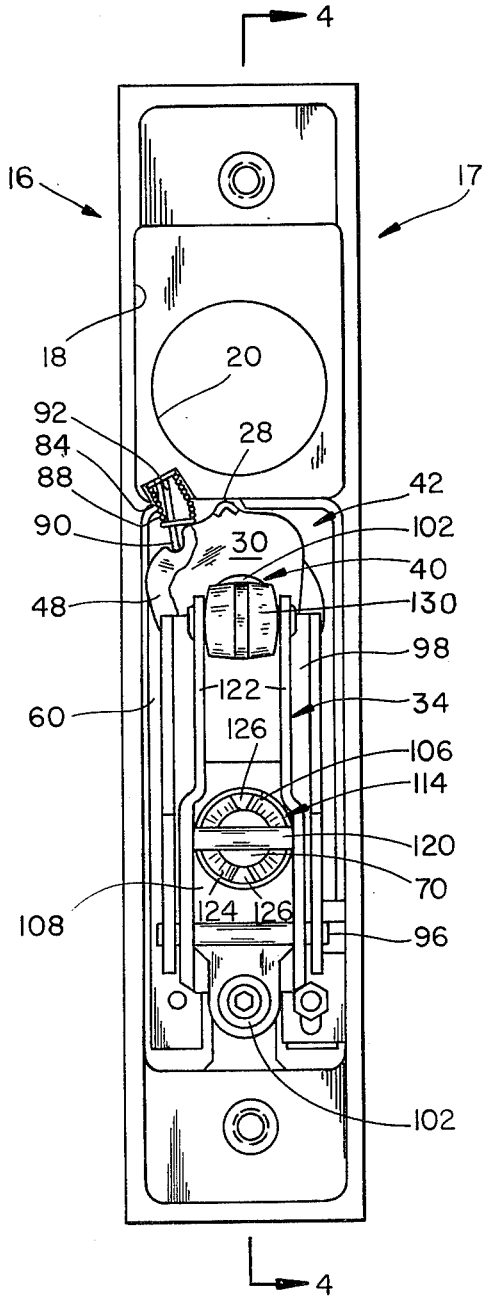
FIG. 3 is a rear elevational view of the apparatus of the instant invention in the closed position.

With particular reference to FIGS. 3, 7, it will be seen that the cylinder lock plates 48 contain aligned notches 82. Housing 16 defines a pocket 84, which extends generally radially from pivot post 40. Pocket 84 is provided with a dogging spring 88 which rests between the end of pocket 84 and the shoulders 90 of an inverted T-shaped spring guide 92. When cylinder lock plates 48 are in their locking positions, illustrated in FIGS. 3–4, the spring guide 92 in pocket 84 is urged by its dogging spring 88 into engagement with notches 82 to hold cylinder lock plates 48 in the locking position. As the cylinder lock plates 48 are turned to their unlocking positions, illustrated in FIGS. 5–6, the spring guide 92 in pocket 84 is urged out of engagement with notches 82.

Figure 4:
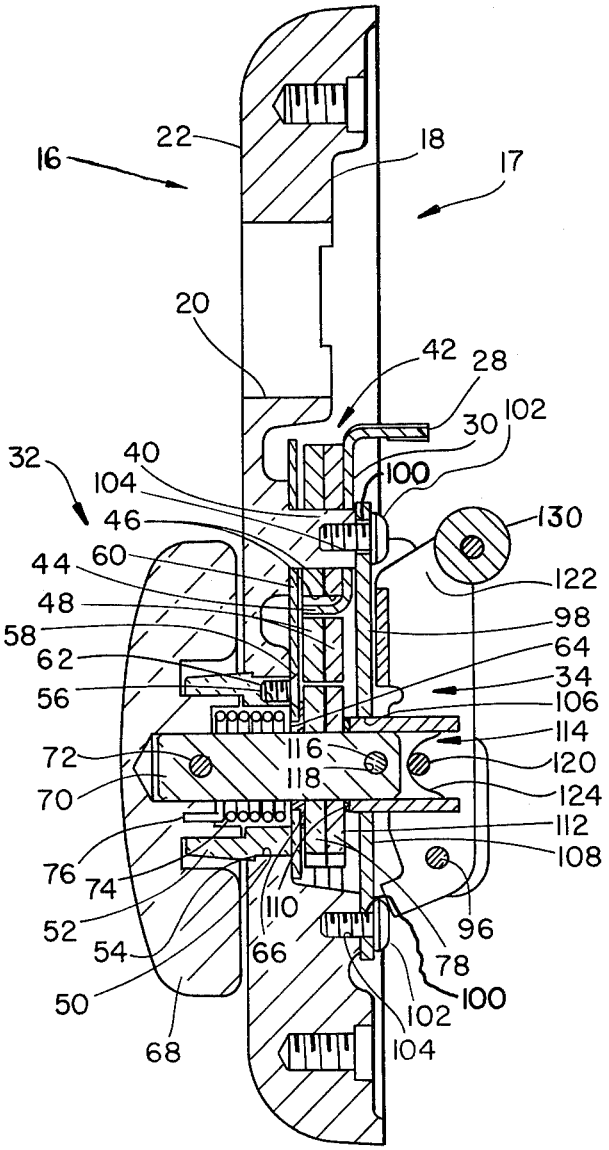
FIG. 4 is a sectional view taken generally along section lines 4—4 of FIG. 3.
Figure 6:
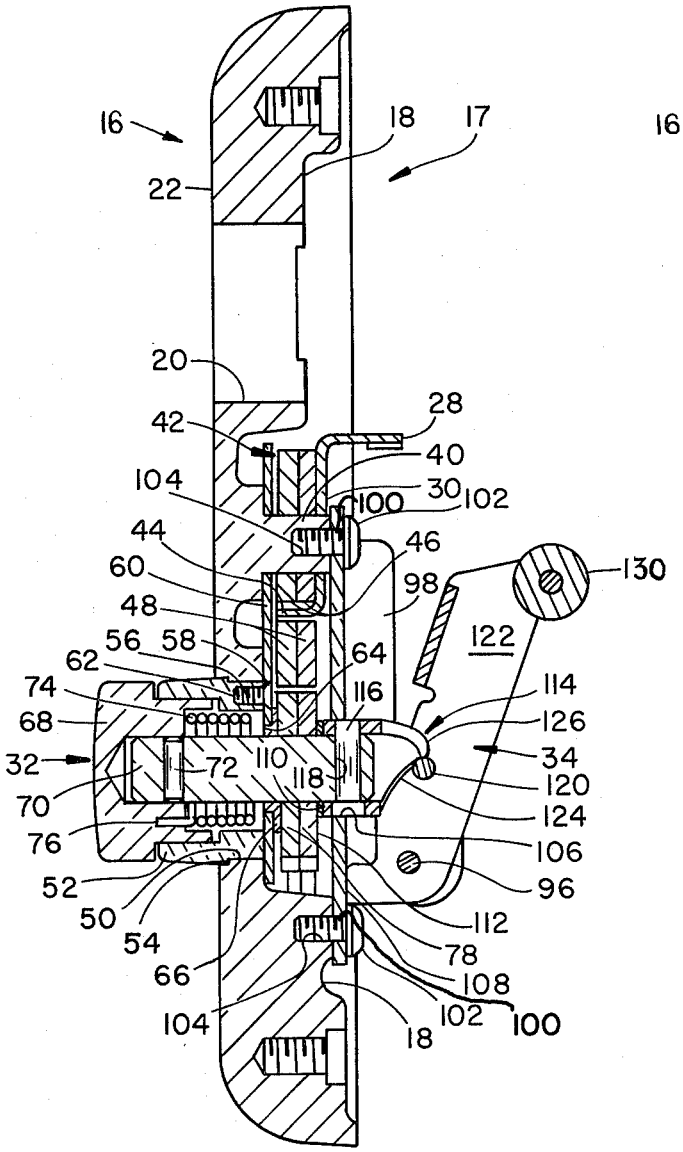
FIG. 6 is a sectional view taken generally along section lines 6—6 of FIG. 5; and, FIG. 7 is an isometric view of certain details of the apparatus of FIGS. 1-6.
Figure 5:
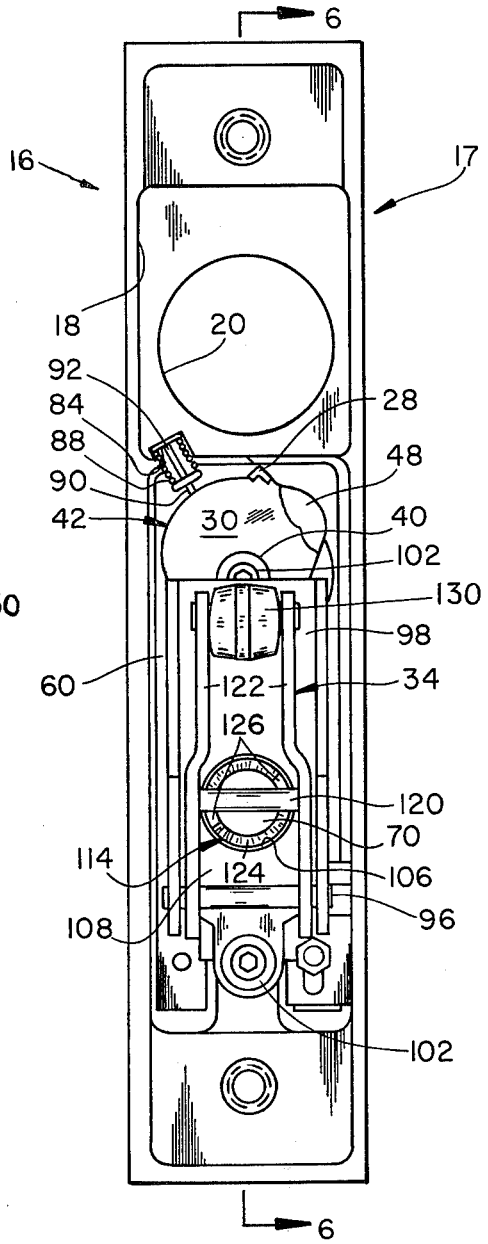
FIG. 5 is a rear elevational view of the apparatus of the instant invention in the door opening position.

Referring now to FIGS. 4–6, the actuator arm 34 is pivotally mounted by a rivet 96 from an actuator back plate 98. The actuator back plate 98 includes apertures 100 adjacent both ends thereof for receiving mounting screws 102, the mounting screws being threaded into mating threaded bores 104 in pivot post 40 and at another location near the bottom of the rearward side 18 of housing 16. Actuator back plate 98 thereby holds many of the previously described components of control assembly 10 in place.

The actuator back plate 98 is generally C-shaped in horizontal section and includes a bore 106 which extends from front to rear of the control assembly 10 through the back 108 thereof. Shaft 70 extends through bore 106. A flat washer 110 is placed on shaft 70 against the rearward surface 112 of the rearward one of lock plates 78.

A generally cylindrically shaped actuator cam 114 is located on the end of shaft 70 which extends through bore 106 and a cam retaining screw 116 is threaded through a threaded bore 118 in the end of shaft 70 to secure actuator cam 114 thereon. The actuator arm 34 includes an actuator pin 120 which serves as a cam follower. Actuator pin 120 extends between the two stiffening and strengthening side walls 122 of actuator arm 34 adjacent the camming surface 124 of actuator cam 114. Rotation of the thumbturn 68 causes the camming surface 124 of actuator cam 114 to move beneath actuator pin 120. As the lobes 126 of camming surface 124 move toward pin 120, the actuator arm 34 is forced rearwardly, as illustrated in FIGS. 5–6. The upper end 128 of actuator arm 34 supports a roller retractor actuator 130 which actuates the bolt 38 of FIGS. 1–2 for withdrawal to allow opening of the door. Typically, the roller retractor actuator 130 will roll across a plate or press against a post (not shown) which is coupled to bolt 38 to actuate the bolt. Of course, the bolt may be of a vertically retractable type, as well as the horizontally retractable type which is illustrated.

What is claimed is:

1. Apparatus for mounting thereof to a door in adjacency to a door-mounted, door-latching and unlatching device for operating the door-latching and unlatching device, comprising a barrel cam, means for actuating the barrel cam, means for following the barrel cam, and actuator means for moving a door-mounted, door-latching and unlatching device, the actuator means being connected to the cam following means for movement in response to actuation of the barrel cam, wherein the following means comprises an actuator pin and the actuator means comprises an actuator arm pivotally mounted adjacent one of its ends, the actuator arm supporting the actuator pin intermediate the ends of the actuator arm and adjacent the barrel cam, and a roller retractor actuator adjacent the other end of the actuator arm.

2. The apparatus of claim 1 wherein the actuator arm is generally U-shaped in cross section, having a pair of lateral stiffening and support arms between which the actuator pin extends and is supported and between which the roller retractor actuator is rotatably supported.

3. Apparatus for mounting thereof to a door in adjacency to a door-mounted, door-latching and unlatching device for operating the door-latching and unlatching device, comprising an actuator, a barrel cam for rotational movement about its axis in response to actuator movement, a barrel cam follower, arm means coupled to the cam follower for movement of said arm means, in response to actuator manipulation, in first and second opposite directions to effect only a rolling contacting engagement of said arm means with a door-mounted, door-latching and unlatching device, wherein the actuator includes a thumbturn and means for connecting the barrel cam to the actuator including a shaft having an end for supporting the thumbturn for rotation, the barrel cam being mounted on the end of the shaft remote from the thumbturn, the following means comprises an actuator pin and the arm means comprises an actuator arm pivotally mounted adjacent one of its ends, the actuator arm supporting the actuator pin intermediate the ends of the actuator arm and adjacent the barrel cam, and a roller retractor actuator adjacent the other end of the actuator arm.

4. The apparatus of claim 3 wherein the barrel cam includes two generally diametrically opposite cam lobes, rotation of the thumbturn in either direction rotating the barrel cam to retract the latch bolt.

* * * * *